US006463224B1

(12) United States Patent
Phillips

(10) Patent No.: US 6,463,224 B1
(45) Date of Patent: Oct. 8, 2002

(54) METHOD AND APPARATUS FOR DETERMINING WHEN A QUANTITY OF TONER IN A REGION DECREASES TO OR BELOW A PREDETERMINED QUANTITY

(75) Inventor: Quintin T. Phillips, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/620,838

(22) Filed: Jul. 21, 2000

(51) Int. Cl.[7] ..... G03G 15/08
(52) U.S. Cl. ..... 399/27
(58) Field of Search ..... 399/27, 29, 30

(56) References Cited

U.S. PATENT DOCUMENTS 4,932,356 A * 6/1990 Watanabe et al. ..... 399/30 X
4,963,927 A * 10/1990 Ishihara ..... 399/29
5,162,849 A * 11/1992 Yoshino et al. ..... 399/29
5,235,391 A * 8/1993 Aimoto ..... 399/29
5,581,326 A * 12/1996 Ogata et al. ..... 399/30
5,787,320 A * 7/1998 Eun et al. ..... 399/27 X

* cited by examiner

*Primary Examiner*—Fred L Braun

(57) ABSTRACT

An embodiment of a toner quantity detection device in an electrophotographic printer includes a configuration to determine if sufficient toner is available for performing imaging operations. The electrophotographic imaging device includes a conveyor for moving toner from a first chamber for storing the toner to a second chamber from which a developing roller removes toner for development. A toner concentration sensor measures the concentration of toner in the second chamber. As imaging operations are performed, the toner in the second chamber is depleted. When the toner concentration falls below a threshold level, the conveyor is actuated to move toner from the first chamber to the second chamber, thereby replenishing the toner in the second chamber. Software operating in a computer coupled to the electrophotographic printer estimates an amount of toner required for performing an imaging operation. Between intervals during which the toner in the second chamber is replenished by actuation of the conveyor, the ratio of the change in toner concentration to the estimated amount of toner required is computed. When this ratio rises above a predetermined value, a signal is generated to indicate that sufficient toner to perform imaging operations may not be available.

23 Claims, 7 Drawing Sheets

METHOD AND APPARATUS FOR DETERMINING WHEN A QUANTITY OF TONER IN A REGION DECREASES TO OR BELOW A PREDETERMINED QUANTITY

FIELD OF THE INVENTION

This invention relates to electrophotographic imaging devices. More particularly, this invention relates to estimating an amount of toner available for performing an imaging operation.

BACKGROUND OF THE INVENTION

Electrophotographic imaging devices, such as electrophotographic copiers (both color and monochrome) and electrophotographic printers (both color and monochrome) use toner to form images on media. Typically, a sensor is used in a toner reservoir to measure a level of the toner in the reservoir. The sensor adds cost and complexity to the electrophotographic imaging device. A need exists for an apparatus capable of estimating an amount of toner available for an imaging operation that does not use a toner level sensor in the reservoir.

SUMMARY OF THE INVENTION

According, a method for determining when a first quantity of toner in a first region of an electrophotographic imaging device decreases to or below a predetermined quantity has been developed. The method includes determining a first value related to a second quantity of the toner for use in an imaging operation and determining a plurality of values related to a third quantity of the toner in a second region of the electrophotographic imaging device. The method further includes determining a second value using selected ones of the plurality of values and the first value and comparing the second value to a predetermined value.

A toner quantity detection device includes a sensor configured to generate a first signal related to a first quantity of toner within a first volume. The toner quantity detection device further includes a processing device arranged to receive the first signal to generate a plurality of values from the first signal and configured to compare a first value to a predetermined value and to generate a second signal if the first value exceeds the predetermined value. The processing device includes a configuration to determine the first value using a second value related to a second quantity of the toner used in performing an imaging operation and using selected ones of the plurality of values of the first signal.

An electrophotographic imaging device to form an image on media using toner includes a photoconductor and a photoconductor exposure system configured to form a latent electrostatic image on the photoconductor. The electrophotographic imaging device further includes a developing device configured to develop the toner onto the photoconductor and a transfer device to transfer the toner from the photoconductor to the media. In addition, the electrophotographic imaging device includes a fixing device to fix the toner to the media and a sensor configured to generate a plurality of values of a first signal related to a first quantity of the toner within the developing device. The electrophotographic imaging device also includes a processing device arranged to receive the plurality of values and configured to compare a first value to a predetermined value and generate a second signal if the first value exceeds the predetermined value. The processing device includes a configuration to determine the first value using a second value related to a second quantity of the toner for performing an imaging operation and using selected ones of the plurality of values of the first signal.

DESCRIPTION OF THE DRAWINGS

A more thorough understanding of embodiments of the toner quantity detection device may be had from the consideration of the following detailed description taken in conjunction with the accompanying drawings in which.

DETAILED DESCRIPTION OF THE DRAWINGS

Although an embodiment toner quantity detection device will be disclosed in the context of an electrophotographic printer, it should be recognized that embodiments of the toner quantity detection device could be used in other electrophotographic imaging devices such as an electrophotographic copier or a facsimile machine. Furthermore, although an embodiment of the toner quantity detection device will be disclosed in the context of a monochrome electrophotographic printer, it should be recognized that embodiments of the toner quantity detection device could be used in either color or monochrome electrophotographic imaging devices.

Figure 1:
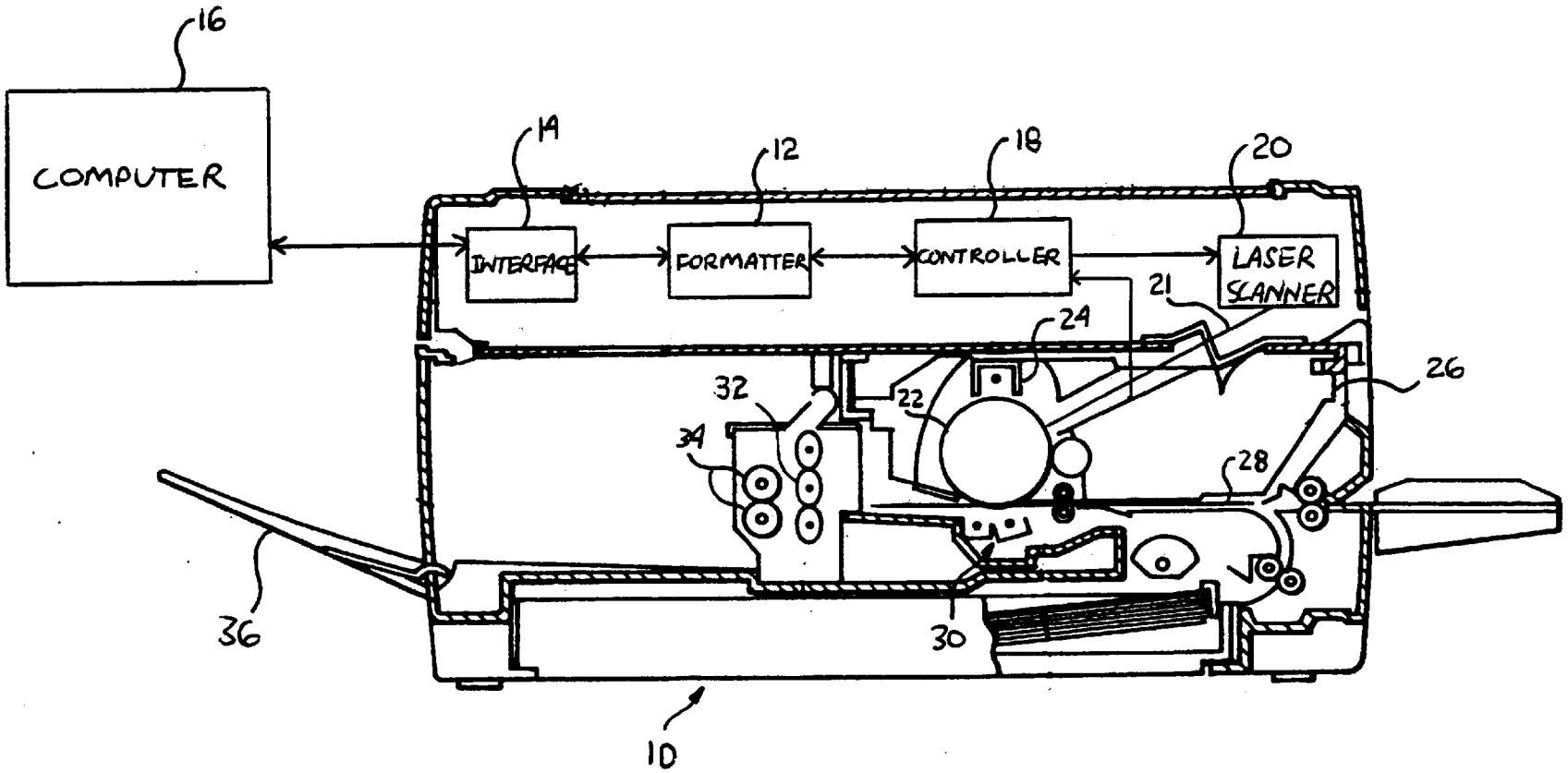
FIG. 1 shows a simplified drawing of an electrophotographic printer including part of an embodiment of the toner quantity detection device.

Shown in FIG. 1 is simplified drawing of an embodiment of an electrophotographic printer, electrophotographic printer 10 including an embodiment of the toner quantity detection device. A processing device, such as formatter 12, receives image related data, such as print data through interface 14. The print data can be generated by a computer 16 executing an application program. The print data could be provided in the form of a display list, vector graphics, or raster print data. Formatter 12 converts this relatively high level print data into a stream of binary print data. Formatter 12 sends the stream of binary print data (video data) to a processing device, such as controller 18. Controller 18 supplies the stream of video data to an embodiment of a photoconductor exposure device, laser scanning system 20. A laser driver included in controller 18 generates pulsating beam 21 corresponding to the video data stream sent to the laser diode in laser scanning system 20.

Laser scanning system 20 includes the optics necessary for focusing pulsating beam 21 upon a photoconductor, such as photoconductor drum 22. In addition, laser scanning system 20 includes a rotating scanning mirror that sweeps pulsating beam 21 across photoconductor drum 22. Other embodiments of the photoconductor could be used, such as a photoconductor belt. Prior to exposure by pulsating beam 21, photoconductor drum 22 is charged by a charging device, such as corona charger 24. Exposure of photoconductor drum 22 by pulsating beam 21 forms a latent electrostatic image on the surface of photoconductor drum 22. Photoconductor drum 22 rotates in a clockwise direction as viewed in FIG. 1. An embodiment of a developing device, such as developing mechanism 26 (shown in a simplified form in FIG. 1) develops toner onto the surface of photoconductor drum 22.

The timing of the exposure of photoconductor drum 22 to pulsating beam 21 and the timing of the movement of media 28 through a media path of electrophotographic printer 10 are carefully controlled. The timing is controlled so that the portion of the surface of photoconductor drum 22 containing the developed latent electrostatic image is rotated into position opposite a section of media 28 to which the print data used to form the latent electrostatic image corresponds. A charging device, such as transfer corona 30 charges a side of media 28, opposite a side of media 28 on which the image will be formed, to a charge of opposite polarity to that of the toner. The electric field created by transfer corona 30 moves the toner from the surface of photoconductor drum 22 onto the surface of media 28. After the transfer operation, media 28 moves through a fixing device, such as fuser 32. Fuser 32 fixes the toner forming the image copied from the document onto the surface of media 28. After exiting fuser 32, media 28 moves through drive rollers 34 and into output tray 36.

In addition to the previously mentioned functions, controller 18 generates signals used to control assemblies within electrophotographic printer 10. These assemblies include a stepper motor coupled to a gear train (neither of which are shown in FIG. 1) that rotates drive rollers for moving media 28 through the media path and solenoids used for loading media 28 into the media path. In addition, these assemblies include a high voltage power supply for supplying bias voltages and currents to charge corona 24, transfer corona 30, and developing mechanism 26.

Figure 2:
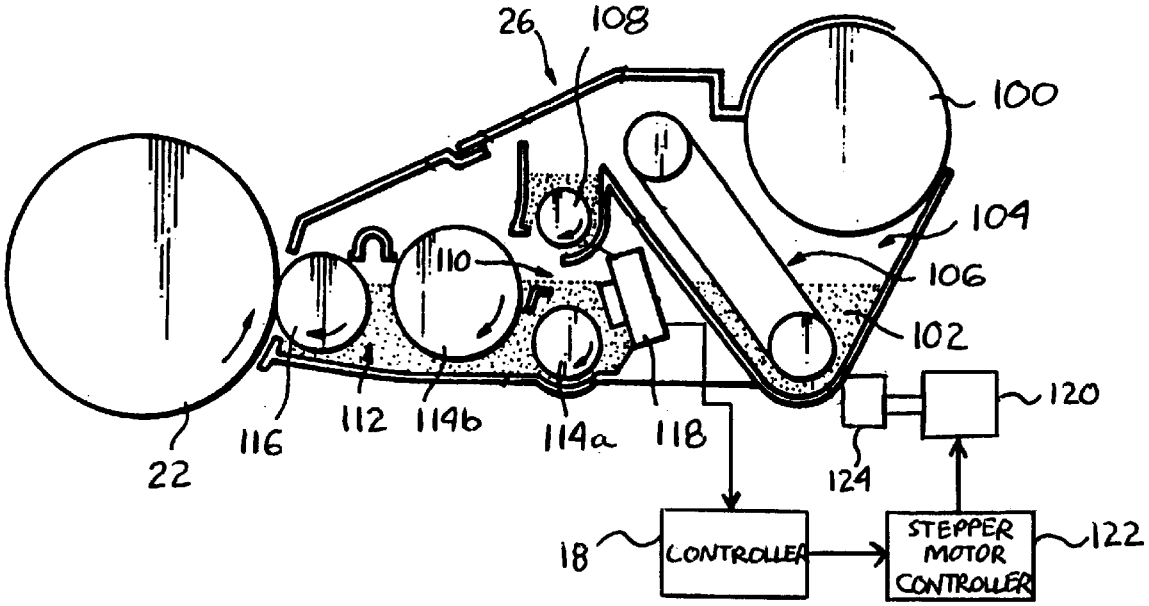
FIG. 2 shows a simplified drawing of a developing mechanism

Shown in FIG. 2 is a simplified drawing of developing mechanism 26. Toner reservoir 100 is used to store toner 102. When developing mechanism 26 no longer contains sufficient toner 102 to adequately develop latent electrostatic images, toner reservoir 100 can be replaced to resupply toner 102. After toner reservoir 100 is installed, toner 102 flows from toner reservoir 100 into chamber 104, filling chamber 104 from the bottom. An embodiment of a toner moving device, including conveyer 106, lifts toner 102 from chamber 104 and deposits toner 102 onto toner replenishing roller 108. Although an embodiment of the toner quantity detection device is disclosed in the context of developing mechanism 26, which makes use of conveyor 106, it should be recognized that other mechanisms may be used. For example, an auger could be used to deliver toner from chamber 104 to toner replenishing roller 108. Or, chamber 104 could be located with respect to toner replenishing roller 108 so that actuation of a shutter at the bottom of chamber 104 would release toner onto toner replenishing roller 108. In the developing implementation in which a shutter is used, toner would be delivered from a toner storage reservoir directly to the chamber in which the developing roller is located, thereby reducing the number of chambers used in the developing device.

Toner replenishing roller 108 includes a magnet having two south poles and two north poles, alternately located, over its circumference. Carrier 110, formed from a material that is magnetically attracted to toner replenishing roller 108, is contained in chamber 112. Carrier 110 magnetically adheres to the surface of replenishing roller 108 forming a brush like layer of carrier (a magnetic brush) on replenishing roller 108. As replenishing roller 108 rotates, the magnetic brush moves toner 102 located above replenishing roller 108 to chamber 112.

Agitating rollers 114*a* and 114*b* mix toner 102 and carrier 110. The mixing of toner 102 and carrier 110 causes triboelectric charging of toner 102. As a result, toner 102 electrostatically adheres to carrier 110. In addition, agitating rollers 114*a* and 114*b* move carrier 110 and adhered toner 102 to developing roller 116. Developing roller 116 includes a magnet to attract and hold carrier 110. The latent electrostatic image on photoconductor 22 is developed when toner on developing roller 116 (electrostatically adhered to carrier 110) leaves carrier 110 and electrostatically adheres to discharged areas (discharged by pulsating beam 21) on the surface of photoconductor drum 22. A time varying signal is applied to developing roller 116. The resulting electric field established between developing roller 116 and photoconductor 22 has the net effect of removing toner 102 from developing roller 116 and depositing it on the discharged areas of photoconductor drum 22. The time varying signal could include a DC component and an AC component. In the case in which a time varying signal is used, the magnitude of the DC component and the magnitude and frequency of the AC component are selected so that the areas on the surface of photoconductor drum 22 that are not discharge are substantially undeveloped.

The quality of the image developed on photoconductor drum 22 is affected by the distribution of toner charge mass ratio. Use of carrier 110 allows for a tighter control of the distribution of toner charge mass ratio than is typically achieved in electrophotographic imaging devices not using a carrier. To achieve the desired range in the toner charge to mass ratio, the ratio of toner 102 to carrier 110 in chamber 112 is controlled. An embodiment of a sensor, such as toner concentration sensor 118 is used to determine relative quantities of toner 102 and carrier 110. Toner concentration sensor 118 measures the ratio between toner 102 and carrier 110 by measuring a change in inductance of the particles present in chamber 112 as toner 102 is depleted. It should be recognized that other types of toner concentration sensors could be used. For example, a toner concentration sensor that measures a change in capacitance of the particles present in chamber 112 as toner is depleted could be used. Furthermore, other embodiments of sensors could be used. For example, an implementation of a toner level sensor could be used to measure a toner level in chamber 112 from which a measure of the ratio between toner 102 and carrier 110 could be derived.

Toner concentration sensor 118 is coupled to controller 18. Controller 18 uses a signal received from toner concentration sensor 118 to generate a measurement of the ratio between toner 102 and carrier 110 in chamber 112. Controller 18 compares this measurement of the ratio to a threshold value to determine if toner 102 must be added to chamber 112. When the ratio between toner 102 and carrier 110 drops to or below the threshold value, controller 18 generates a command to actuate stepper motor 120 (shown schematically in FIG. 2). In response, stepper motor controller 122 causes a corresponding rotation of a shaft of stepper motor 120, which in turn through gear train 124 (shown as a box in FIG. 2) causes conveyor 106 to deliver toner 102 to toner replenishing roller 108. The amount of toner 102 delivered to toner replenishing roller 108 is dependent upon the measurement generated by controller 18.

The embodiment of the toner quantity detection device uses the signal generated by toner concentration sensor 118 and the actuation by controller 18 of conveyor 106 to measure the amount of toner available for imaging in chamber 104. In addition, the embodiment of the toner quantity detection device makes use of an estimate of coverage for the image that is to be formed upon media 28 to estimate the amount of toner available in chamber 104.

Shown in FIGS. 3A–3D are four graphs of exemplary simulated data that would be used by the embodiment of the toner quantity detection device to estimate the amount of toner available in chamber 104. For each of these graphs, the horizontal axis corresponds to the percentage of total life consumed with the end of life occurring when toner 102 available in chamber 104 for forming images on media 28 is consumed. The vertical axis is in relative units.

Figure 3A:
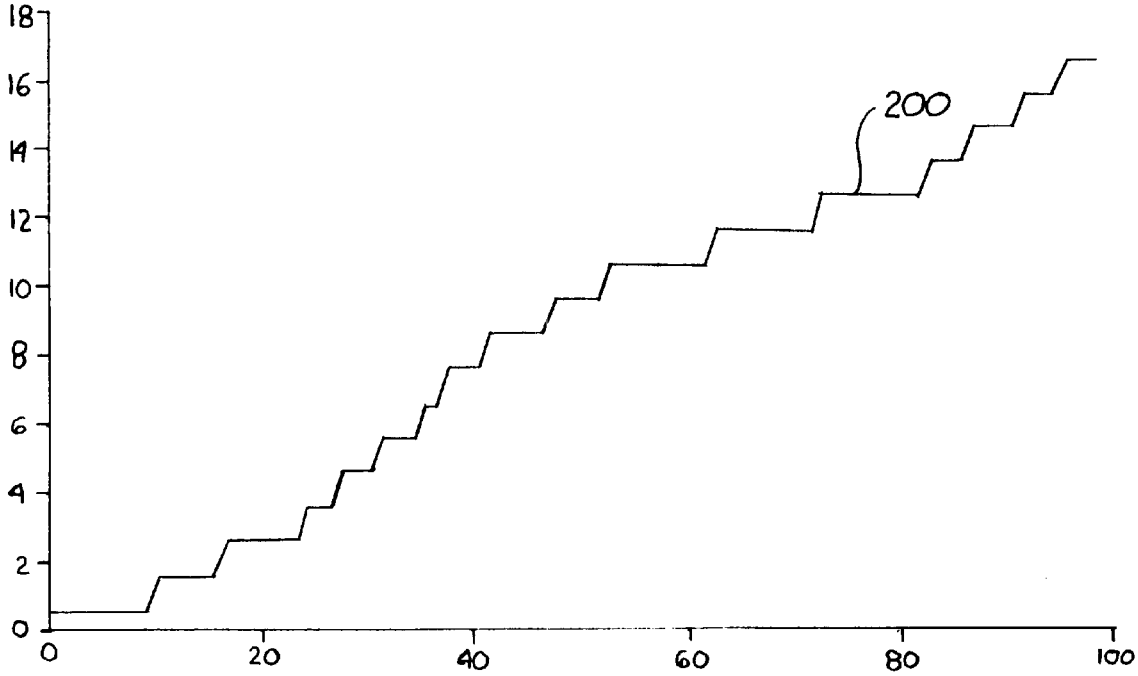
FIGS. 3A–3D show graphs of simulated data related to the operation of the embodiment of the toner quantity detection device.

FIG. 3A shows the rotations of conveyor 106 over a time period that the toner 102 available from toner reservoir 100 is consumed. Curve 200 represents the cumulative number of rotations of conveyor 106. During the interval in which conveyor 106 is rotated to deliver toner 102 to replenishing roller 108, curve 200 has a steep upward slope corresponding to the accumulating number of rotations of conveyor 106. Between the times at which conveyor 106 is actuated, curve 200 is flat corresponding to conveyor 106 remaining stationary. As will be discussed in more detail later in the specification, the intervals of particular interest in measuring the amount of toner 102 available in chamber 104 are those in which conveyor 106 is stationary.

Figure 3B:
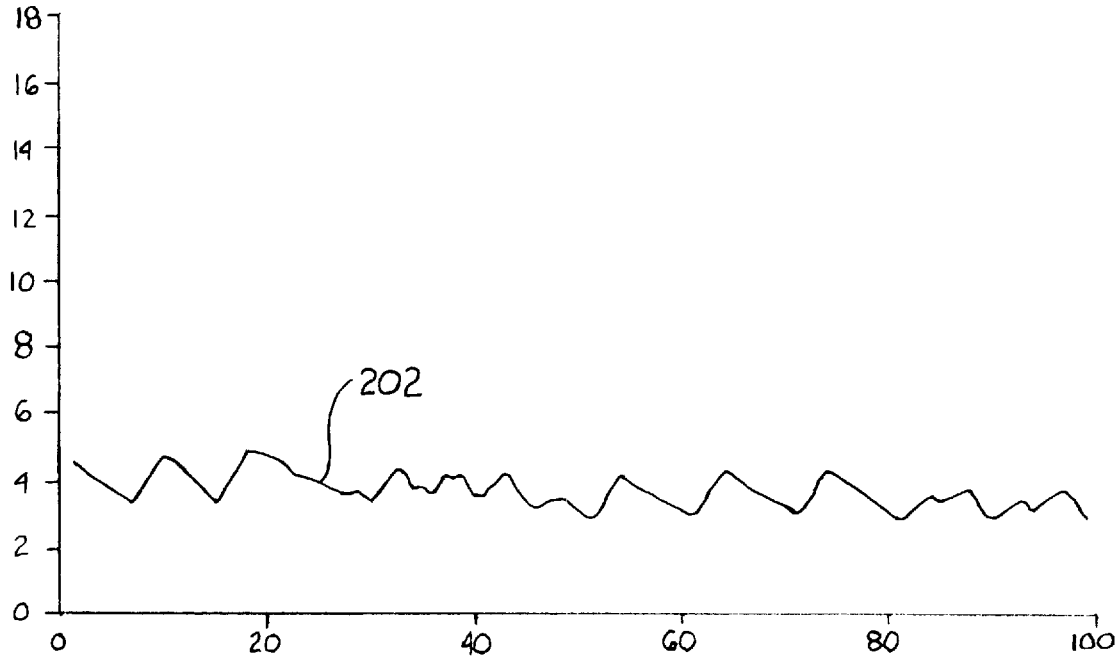

FIG. 3B shows the signal generated by toner concentration sensor 118. Curve 202 shows the variation in measured toner concentration as toner 102 in chamber 112 is alternately depleted through consumption and then recharged by the actuation of conveyor 106. The upward sloping portions of curve 202 correspond to those times during which conveyor 106 is delivering toner 102 to toner replenishing roller 108. The rotation of toner replenishing roller 108 increases the amount of toner 102 in chamber 112, thereby increasing the measured toner concentration. The downward sloping portions of curve 202 correspond to the those times during which toner 102 in chamber 112 is consumed by development of the latent electrostatic images formed on photoconductor drum 22. As toner 102 is delivered from developing roller 116 to the latent electrostatic images formed on photoconductor drum 22, toner 102 is removed from chamber 112, thereby decreasing the measured toner concentration. As will be discussed in more detail later in the specification, the intervals of particular interest in estimating the amount of toner 102 available in chamber 104 are those in which curve 202 has a downward slope.

Figure 3C:
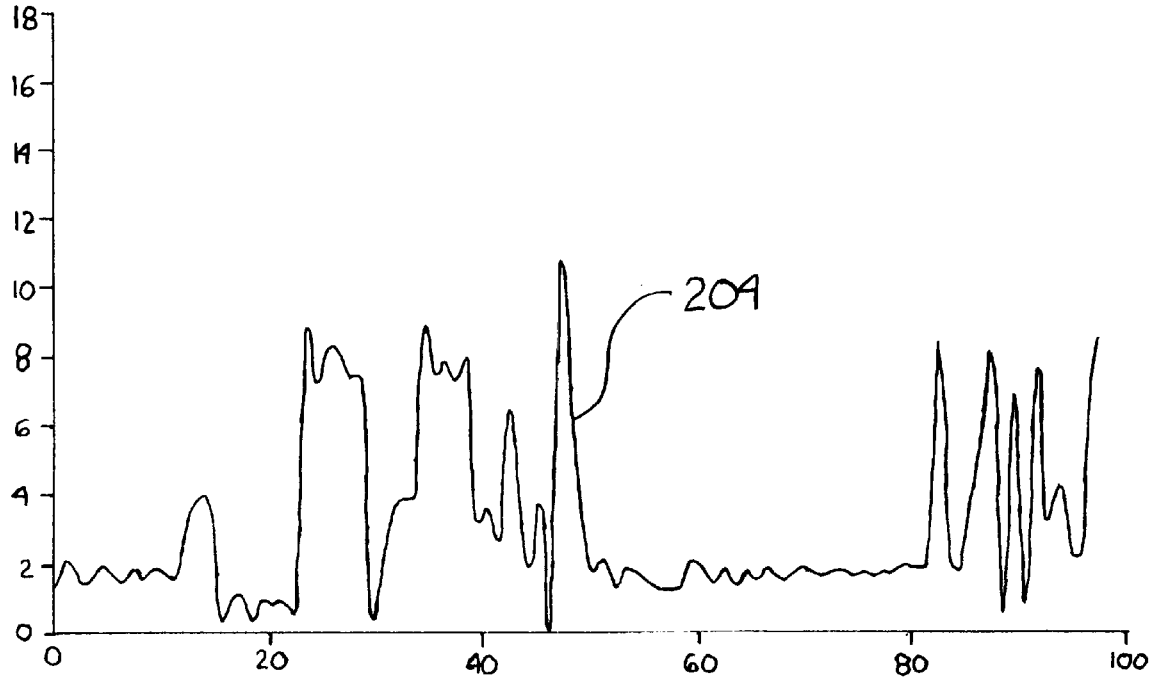

FIG. 3C shows an estimate of the coverage on units of media 28 in the imaging operation. Curve 204 shows the variation in this estimate over the time period during which toner 102 is available in chamber 104 for performing imaging operations. The coverage estimate is generated based upon an estimate of the portion of media 28 that will be covered, on a unit by unit basis, with toner 102 as a result of the imaging operation.

The estimate of the portion of media 28 that will be covered can be used to form an estimate of toner usage. However, depending upon the conditions under which the imaging operation is performed, this estimate can vary substantially from actual toner usage. Furthermore, because the variation of the usage estimate from the actual usage can be systematic, substantial errors in the estimation can accumulate over the performance of multiple imaging operations. Environmental factors, such as temperature and humidity, are one source contributing to the systematic variation. Temperature and humidity can affect the amount of toner that forms the image on media 28 by affecting development and toner flow characteristics.

Another source of error in the estimate of coverage comes about from the way in which the estimate is calculated. Generation of the estimate of coverage can be performed within electrophotographic printer 10 or within computer 16. The computation of the estimate includes computing, for each unit of media 28 that will be used in the imaging operation, the number of pixels onto which toner will be placed. To generate the estimate of coverage in a way that does not contribute excessively to the time for execution of the imaging operation, the coverage is computed with a pixel resolution corresponding to 50 pixels per inch even though the image may be formed at a higher image such as 600 pixels per inch. However, it should be recognized that the estimated coverage could be computed with a pixel resolution corresponding to 600 pixels per inch or some other resolution lower than 600 pixels per inch. The difference between the pixel resolution used for computing the coverage estimate and the actual pixel resolution used contributes to error in the estimate.

Embodiments of the toner quantity detection device use feedback to at least partially compensate for the systematic variation in the estimate of toner usage from the actual toner usage. Using only the estimated pixel coverage to estimate toner consumption does not compensate for the various factors that can affect toner consumption.

Figure 3D:
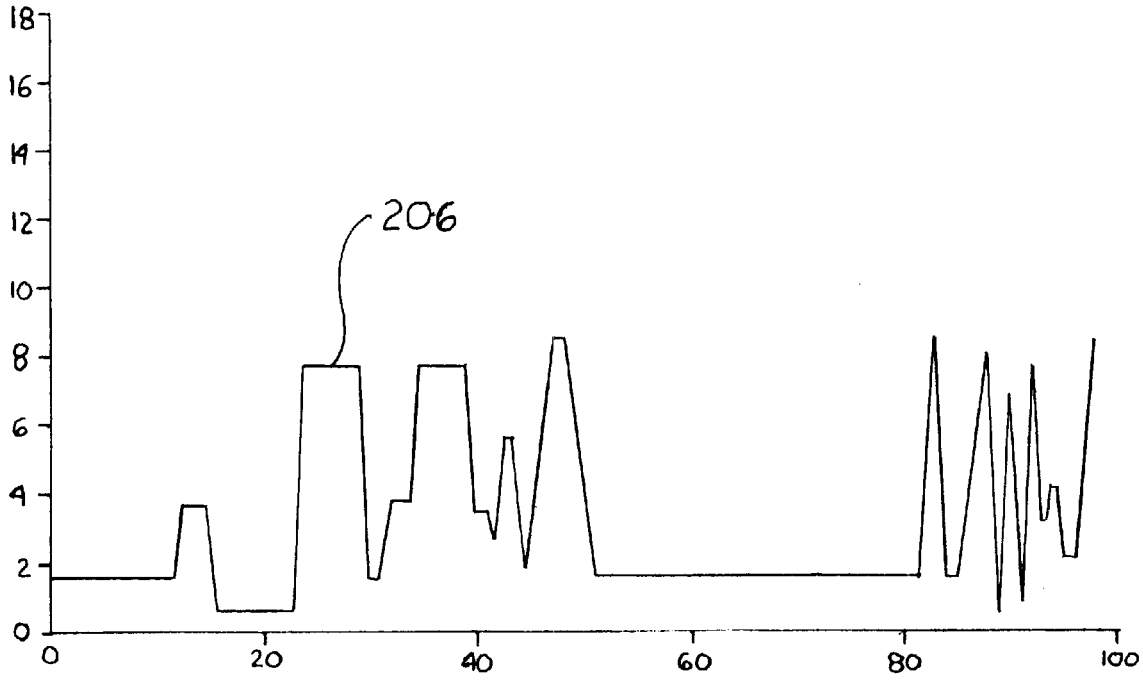

FIG. 3D shows the coverage of media 28 computed at the pixel resolution at which the imaging operation will be performed on media 28. Curve 206 shows the variation, over successive imaging operations, of the coverage at the pixel resolution for forming the image on media 28. This variation is affected by the image that is to be formed on media 28. Where, over multiple units of media 28, curve 206 is flat, this corresponds to images having substantially the same coverage at the actual pixel resolution formed on the multiple units of media 28. This situation may occur when, for example, multiple copies of the same image are to be formed on successive units of media 28. The coverage at the actual pixel resolution is computed from the rasterization, at the actual pixel resolution used, performed as part of the imaging operation. The computed coverage at the actual pixel resolution is used to correct the estimate computed at the lower pixel resolution. By comparing the coverage at the actual pixel resolution for a unit of media 28 to the estimated coverage an adjustment factor is generated that is used to correct future estimates. The effect of this feedback is seen in the convergence of curve 204 with curve 206 after performing imaging operations, on multiple units of media 28 having substantially the same coverage, at the actual pixel resolution. Further disclosure regarding the computation of the estimated coverage can be found in copending U.S. patent application Ser. No. 09/602,640 entitled "IMAGE FORMING SYSTEMS AND METHODS OF FORMING AN IMAGE" and assigned to Hewlett-Packard Company, U.S. Pat. No. 5,797,061 entitled "METHOD AND APPARATUS FOR MEASURING AND DISPLAYING A TONER TALLY FOR A PRINTER", issued to Overall et al., and assigned to Lexmark International Inc., U.S. Pat. No. 5,937,225 entitled "PIXEL COUNTING TONER OR INK USE MONITOR AND PIXEL COUNTING METHOD FOR MONITORING THE TONER OR INK USE", issued to Samuels, and assigned to International Business Machines Corporation, the disclosures of which are incorporated by reference in their entirety into this specification.

Figure 4:
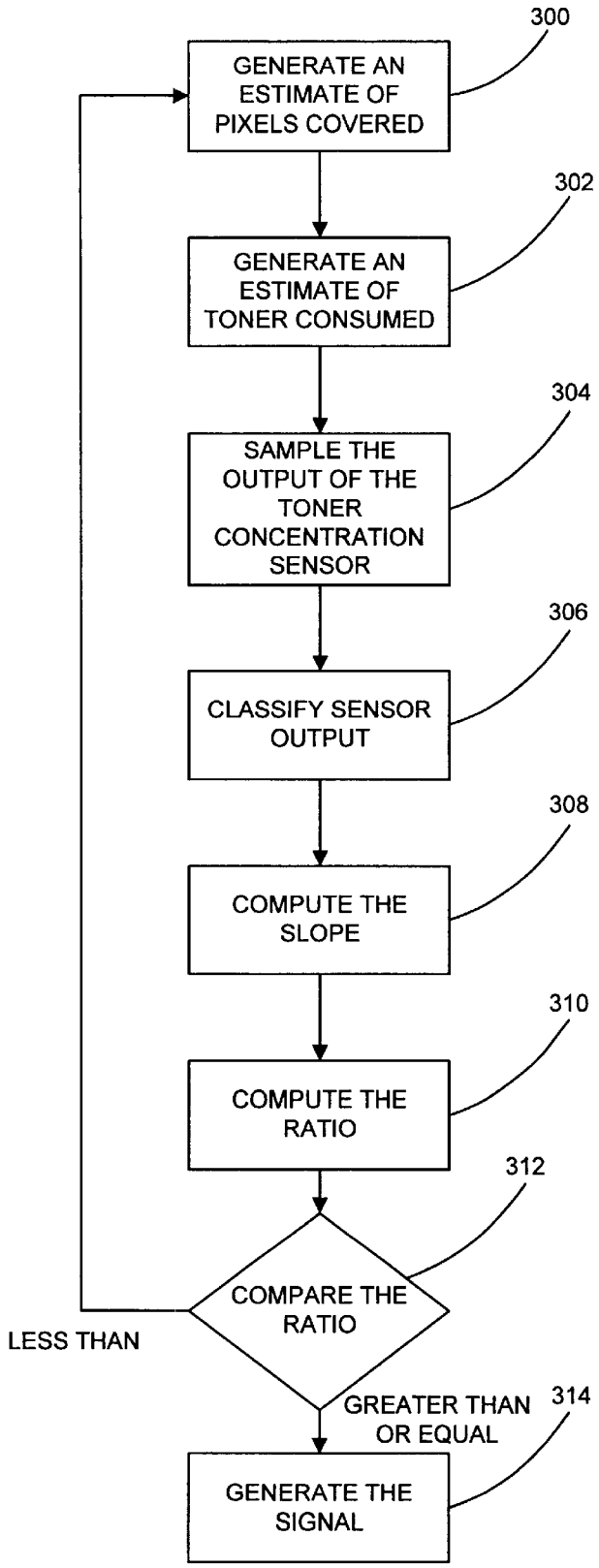
FIG. 4 shows a high level flow diagram of a method for using an embodiment of the toner quantity detection device.

Shown in FIG. 4 is a flow diagram illustrating operation of an embodiment of the toner measuring system. First, in step 300, software executing in computer 16 generates an estimate of the number of pixels to be covered with toner 102 (for all units of media 28 to be used) in the imaging operation. To reduce the time required to generate the estimate, the number of pixels may be computed at a lower pixel resolution. Alternatively, the estimate of the number of pixels to be covered with toner 102 could be generated in firmware operating within formatter 12 or controller 18. Next, in step 302, the software generates an estimate of the toner that will be consumed in completing the imaging operation. To arrive at the estimate of toner usage, the software uses the estimate of covered pixels and a value relating to the volume of toner used to cover a pixel. This value may be empirically or analytically derived.

In step 304, controller 18 samples the output of toner concentration sensor 118 to measure the change in the concentration of toner 102 in chamber 112 as images are formed on units of media 28. When controller 18 samples the output of toner concentration sensor 118, it also identifies the time at which that sample was taken (this could be done, for example, counting clock cycles and recording the number of the clock cycle on which the sample was taken). Next, in step 306, controller 18 classifies the sampled output of toner concentration sensor 118. Those samples taken when conveyor 106 is moving toner from chamber 104 onto toner replenishing roller 108 are classified as toner replenishment samples. Those samples taken when conveyor 106 is not moving toner from chamber 104 onto toner replenishing roller 108 are classified as non-toner replenishment samples. The classification of the samples could be done by a setting (or not setting) a flag associated with each of the sampled values from toner concentration sensor 118 depending upon whether the sample was classified as a toner replenishment sample or a non-toner replenishment sample.

As previously mentioned, FIG. 3B shows the variation in the concentration of toner 102 as toner 102 is consumed during imaging operations and as toner 102 is replenished. The samples taken by controller 18 during the upward sloping portion of curve 202 are taken while the concentration of toner 102 is increasing because of toner 102 being moved from chamber 104 onto toner replenishing roller 108 by conveyor 106. These samples are classified as toner replenishment samples. The samples taken by controller 18 during the downward sloping portion of curve 202 are taken while the concentration of toner 102 in chamber 112 is decreasing because imaging operations are removing toner 102 from chamber 112. These samples are classified as non-toner replenishment samples.

In step 308, controller 18 computes the slope of the downward sloping portion of curve 202. This downward slope represents the rate of change in the concentration of toner 102 as toner 102 is consumed during imaging operations. The magnitude of the computed slope is related to the amount of toner 102 used for the imaging operation and the quantity of toner 102 present in chamber 112. When the amount of toner 102 available in chamber 104 for delivery to toner replenishment roller 108 reaches a certain threshold value, the amount of toner 102 moved from chamber 104 to toner replenishing roller 108 decreases. As a result, for imaging operations covering the same number pixels on units of media 28, toner 102 in chamber 112 will decrease more rapidly than it would decrease had the quantity of toner 102 in chamber 104 been above the threshold value. Although this embodiment of the toner quantity detection device uses controller 18 to compute the slope of curve 202, it should be recognized that other processing devices could be used to perform this computation. For example, this computation could be performed within formatter 12, or within computer 16.

In step 310 controller 18 computes a ratio between the slope of the downward sloping portion of curve 202 and the estimated amount of toner 102 that will be used for the imaging operation. By dividing the computed value of the slope of curve 202 by the estimated amount of toner 102 that will be used in completing the imaging operation, there is an accounting for the effect of the change in the total pixel coverage between imaging operations (which may be performed on single units of media 28 or multiple units of media 28) resulting from a change in the images that will be formed. Although this embodiment of the toner quantity detection device computes the downward slope of curve 202 over the length of an imaging operation that may use multiple units of media 28 (and consequently may use a computation of the estimated usage of toner 102 for performing the imaging operation on multiple units of media 28) an alternative embodiment of the toner quantity detection device could compute the downward slope of curve 202 for a single unit of media 28.

In step 312, controller 18 compares the computed ratio to a reference value of the ratio. In alternative embodiments of the toner quantity detection device, this comparison could be done in formatter 12 or in computer 16. If this value is greater than or equal to the reference value (in a statistical sense) then, in step 314, controller 18 generates a signal, sent to formatter 12, indicating that the quantity of toner 102 available in chamber 104 for imaging operations may not be sufficient for acceptably completing the next imaging operation. Formatter 12 could either (or both) signal the user through a display on electrophotographic printer 10 or signal the user through computer 16. If this value is less than the reference value, then control is returned to step 300.

The reference value used for comparison in step 312 may be determined in a variety of ways. The reference value may be empirically determined by measuring the values of the ratio (and computing a change in toner concentration), during intervals in which sufficient toner 102 is present in chamber 104 to adequately perform the imaging operation and intervals between actuations of conveyor 106. The measured values of the ratio (measured on multiple electrophotographic imaging devices over time) would then be used to determine statistical parameters of the resulting distribution (such as, mean and standard deviation). Using these statistical parameters, the reference value would be determined. For example, if the empirically determined distribution was a normal distribution, then the reference value could be determined so that, during normal operation, only one tenth of one percent of the computed ratios would be expected to equal or exceed the reference value. If the computed ratio did equal or exceed the reference value, this would indicate that there is a high likelihood that sufficient toner 102 does not remain in chamber 104 to acceptably perform future imaging operations.

An alternative way to determine the reference value includes customizing the reference value for each electrophotographic imaging device. Determining the reference value in this manner involves determining the distribution of the ratio for the electrophotographic imaging device in which the reference value will be used. Values of the ratio are measured and collected over the course of the imaging operations performed. From the collected values, the distribution is determined for that electrophotographic imaging device. The reference value is computed using the distribution and based upon the desired statistical significance for the case in which the computed ratios equal or exceed the reference value.

Although an embodiment of the toner quantity detection device has been illustrated and described, it is readily apparent to those of ordinary skill in the art that various modifications may be made to this embodiment that are within the scope of the appended claims.

What is claimed is:

1. A method for determining when a supply of toner in a first region of an electrophotographic imaging device decreases to or below a threshold quantity, comprising:

determining an estimate of an amount of the toner for use in an imaging operation;

determining a plurality of values related to an amount of the toner in a second region of the electrophotographic imaging device;

determining a ratio using selected ones of the plurality of values and the estimate; and comparing the ratio to a reference value.

2. The method as recited in claim 1, wherein:

using selected ones of the plurality of values including selecting the ones of the plurality of values collected during intervals between operation of a toner movement device.

3. The method as recited in claim 2, wherein:

the plurality of values includes a plurality of values of toner concentration in the second region.

4. The method as recited in claim 3, wherein:

determining a concentration of the toner includes measuring values of a signal generated by a sensor.

5. The method as recited in claim 4, wherein:

determining the ratio includes determining a magnitude of a difference between the selected ones of the plurality of values and forming a ratio of the magnitude of the difference between the selected ones of the plurality of values and the estimate.

6. The method as recited in claim 5, further comprising:

generating a second signal to indicate the supply of the toner decreasing to or below the threshold quantity if the ratio exceeds the reference value.

7. The method as recited in claim 6, wherein:

determining the estimate includes estimating the amount of the toner for use in the imaging operation using a first resolution lower than a second resolution used to perform the imaging operation.

8. The method as recited In claim 7, wherein:

a processing device in the electrophotographic imaging device determines the estimate as an estimate of the amount of the toner for use in the imaging operation, measures the plurality of values of the first signal, selects the ones of the plurality of values and compares the ratio to the reference value.

9. The method as recited in claim 7, wherein:

a computer determines the estimate as an estimate of the amount of the toner for use in the imaging operation; and a processing device in the electrophotographic imaging device measures the plurality of values of the first signal, selects the ones of the plurality of values and compares the ratio to the reference value.

10. A method for determining when a first quantity of toner in a toner reservoir of an electrophotographic imaging device decreases to or below a threshold value, comprising:

determining an estimate of a second quantity of the toner for use in an imaging operation;

measuring a concentration of the toner in a chamber of the electrophotographic imaging device to generate a plurality of measurements;

determining a slope, corresponding to a rate of change of the concentration of the toner in the chamber, using the plurality of measurements;

forming a ratio of the slope to the estimate; and comparing the ratio to a reference value.

11. A toner quantity detection device, comprising:

a sensor configured to generate a first signal related to an amount of toner within a first chamber; and a processing device arranged to receive the first signal to generate a plurality of values from the first signal and configured to compare a ratio to a reference value and to generate a second signal if the ratio exceeds the reference value, where the processing device includes a configuration to determine the ratio using an estimate of the toner used in performing an imaging operation and using selected ones of the plurality of values of the first signal.

12. The toner quantity detection device as recited in claim 11, further comprising:

a toner movement device, with the processing device configured to actuate the toner movement device to move the toner from within a second chamber to the first chamber based upon the plurality of values.

13. The toner quantity detection device as recited in claim 12, wherein:

the processing device includes a configuration to select the seleted ones of the plurality of values of the first signal corresponding to time intervals between operation of the toner movement device.

14. The toner quantity detection device as recited in claim 13, wherein:

the processing device includes a configuration to determine the ratio by forming a ratio of a magnitude of a difference between the selected ones of the plurality of values and the estimate.

15. The toner quantity detection device as recited in claim 14, wherein the processing device includes a controller; and the toner movement device includes a conveyor.

16. The toner quantity detection device as recited in claim 15, further comprising:

a computer, configured to generate the estimate, coupled to an electrophotographic imaging device including the toner quantity detection device.

17. The toner quantity detection device as recited in claim 16, wherein:

the computer includes a configuration to generate the estimate using a first resolution lower than a second resolution used to perform the imaging operation.

18. An electrophotographic imaging device to form an image on media using toner, comprising:

a photoconductor;

a photoconductor exposure system configured to form a latent electrostatic image on the photoconductor;

a developing device configured to develop the toner onto the photoconductor;

a transfer device to transfer the toner from the photoconductor to the media;

a fixing device to fix the toner to the media;

a sensor configured to generate a plurality of values of a first signal related to a supply of toner in a first location within the developing device; and a processing device arranged to receive the plurality of values and configured to compare a ratio to a reference value and generate a second signal if the ratio exceeds the reference value, wherein the processing device includes a configuration to determine the ratio using an estimate of the toner for performing an imaging operation and using selected ones of the plurality of values of the first signal.

19. The electrophotographic imaging device as recited in claim 18, further comprising:

a toner movement device, with the processing device configured to actuate the toner movement device to move the toner to the first location within the developing device from a second location based upon the plurality of values.

20. The electrophotographic imaging device as recited in claim 19, wherein:

the processing device includes a configuration to select the selected ones of the plurality of values of the first signal corresponding to time intervals between operation of the toner movement device.

21. The electrophotographic imaging device as recited in claim 20, wherein:

the processing device includes a configuration to determine the ratio by forming a ratio of a magnitude of a difference between the selected ones of the plurality of values and the estimate.

22. With a computer coupled to the electrophotographic imaging device configured to generate the estimate, the electrophotographic imaging device as recited in claim 21, wherein:

the processing device includes a controller; and the toner movement device includes a conveyor.

23. A toner quantity detection device, comprising:

a toner concentration sensor configured to generate a first signal related to a first quantity of toner within a volume; and a processing device arranged to receive the first signal and configured to make a plurality of measurements of the first signal, configured to compare a ratio to a reference value, configured to generate a second signal if the ratio exceeds the reference value, configured to determine a slope using selected ones of the plurality of measurements, with the slope corresponding to a rate of change of concentration of the toner in the volume, configured to determine an estimate of a second quantity of the toner for use in an imaging operation, and configured to determine the ratio as the slope divided by the estimate.

* * * * *